US005839666A

United States Patent [19]

Heimann et al.

[11] Patent Number: 5,839,666

[45] Date of Patent: Nov. 24, 1998

[54] ADJUSTABLE-SPRAY NONLIMING SHOWER HEAD

[75] Inventors: Bruno Heimann, Fröndenberg; Gerd Scherzberg, Wetter, both of Germany

[73] Assignee: Friedrich Grohe Ag, Hemer, Germany

[21] Appl. No.: 841,276

[22] Filed: Apr. 29, 1997

[30] Foreign Application Priority Data

May 25, 1996 [DE] Germany ..... 196 21 220.0

[51] Int. Cl.[6] ..... B05B 1/32

[52] U.S. Cl. ..... 239/439; 239/447; 239/449; 239/452; 239/460

[58] Field of Search ..... 239/449, 447, 239/602, 104, 533.13, 452, 459, 460, 570, 439

[56] References Cited

U.S. PATENT DOCUMENTS

| | | | |
|---|---|---|---|
| 2,953,248 | 9/1960 | Troland | 239/107 |
| 3,826,429 | 7/1974 | Moen . | |
| 3,929,287 | 12/1975 | Givler et al. | 238/449 X |
| 4,398,669 | 8/1983 | Fienhold | 234/449 X |
| 4,588,130 | 5/1986 | Trenary et al. | 239/449 X |

FOREIGN PATENT DOCUMENTS

| | | | |
|---|---|---|---|
| 486947 | 9/1952 | Canada | 239/107 |
| 36405 | 9/1991 | European Pat. Off. | 239/533.13 |

*Primary Examiner*—Kevin Weldon
*Attorney, Agent, or Firm*—Herbert Dubno; Andrew Wilford

[57] ABSTRACT

A shower head has a body forming a rear compartment pressurizable with water and a forwardly open mouth having an inner periphery and an end disk generally closing the mouth, extending perpendicular to an axis, and having an elastically deformable outer rim formed with a plurality of axially through-going and radially outwardly open grooves opening rearwardly into the compartment and radially outwardly closed by the body. The rim further is formed with an annular and elastically deformable lip projecting axially past a downstream face of the disk and a downstream end of the body. The grooves are formed in the lip. Thus the critical downstream ends of the flow passages constituted by the grooves are formed in an elastically deformable lip that can be deformed. Since the deposits are normally very hard, such deformation of the lip will flake any lime deposits off.

19 Claims, 5 Drawing Sheets

ADJUSTABLE-SPRAY NONLIMING SHOWER HEAD

FIELD OF THE INVENTION

The present invention relates to shower head. More particularly this invention concerns an adjustable-spray shower head.

BACKGROUND OF THE INVENTION

A shower head as described in U.S. Pat. No. 3,826,429 of Moen has a body forming a rear compartment pressurizable with water and a forwardly open mouth having an inner periphery and an end disk generally closing the mouth, extending perpendicular to an axis, and having an outer rim formed with a plurality of axially throughgoing and radially outwardly open grooves opening rearwardly into the compartment and radially outwardly closed by the body.

The disk can normally be displaced axially in the body so as to vary the flow from the grooves. Other structure can also be provided to divert the incoming flow to different sets of apertures.

When such a shower is turned off the head generally drains. The water left at the downstream ends of the grooves dries, leaving behind whatever minerals it carries. The resultant liming of the grooves eventually blocks them, making the shower head unusable unless it is subjected to a difficult cleaning or soaking to remove the deposits.

OBJECTS OF THE INVENTION

It is therefore an object of the present invention to provide an improved shower head.

Another object is the provision of such an improved shower head which overcomes the above-given disadvantages, that is which can be cleared of lime deposits relatively easily.

SUMMARY OF THE INVENTION

A shower head has according to the invention a body forming a rear compartment pressurizable with water and a forwardly open mouth having an inner periphery and an end disk generally closing the mouth, extending perpendicular to an axis, and having an elastically deformable outer rim formed with a plurality of axially throughgoing and radially outwardly open grooves opening rearwardly into the compartment and radially outwardly closed by the body. The rim further is formed with an annular and elastically deformable lip projecting axially past a downstream face of the disk and a downstream end of the body. The grooves are formed in the lip.

Thus with this system the critical downstream ends of the flow passages constituted by the grooves are formed in an elastically deformable lip that can be deformed. Since the deposits are normally very hard, such deformation of the lip will flake the deposits off.

According to the invention the lip projects axially downstream past the disk face by between 0.1 mm and 5 mm, preferably 2 mm. The rim can be unitary with the end disk in which case the disk is rigid except at the rim. Such rigidity can be imparted by making the disk extra thick in its center or providing it with a molded-in reinforcing part, for instance a metal disk. Alternately the rim is a separate ring fixed to the disk. Normally the ring is bonded, for instance by vulcanization or an appropriate adhesive to the disk.

Alternately it can be formed with an annular ridge that is snapped into a complementary groove of the disk. This ridge is of a rigid plastic and the ring is formed of a thermoplastic elastomer.

The lip in accordance with the invention tapers axially downstream and has an inner wall forming an angle of 20° to 70° with the axis and with a downstream end having a radial thickness of 0.3 mm to 2 mm. In another arrangement the lip is formed by an annular array of projections each formed with a respective one of the grooves.

Each groove according to the invention is of generally rectangular section and has a floor directed radially outward away from the axis. At least some of the floors of the grooves are inclined at an acute angle to the axis. Normally the grooves are arrayed in sets and in each set the angle of the respective floors to the axis changes from groove to groove. The inclined groove floors constrict the grooves in a downstream direction and the lip has a stepped inner wall that forms a varying angle with the axis. The angle of the stepped inner wall with the axis varies between 15° and 30°. The grooves have an angular width of about 0.9 mm and a radial width of at least 0.45 mm. The angle the floors are inclined to the axis varies between 0° and 15°. The rim has a Shore A hardness between 35 and 50 and means is provided for axially shifting the disk in the body.

BRIEF DESCRIPTION OF THE DRAWING

The above and other objects, features, and advantages will become more readily apparent from the following description, reference being made to the accompanying drawing in which.

SPECIFIC DESCRIPTION

Figure 1A:
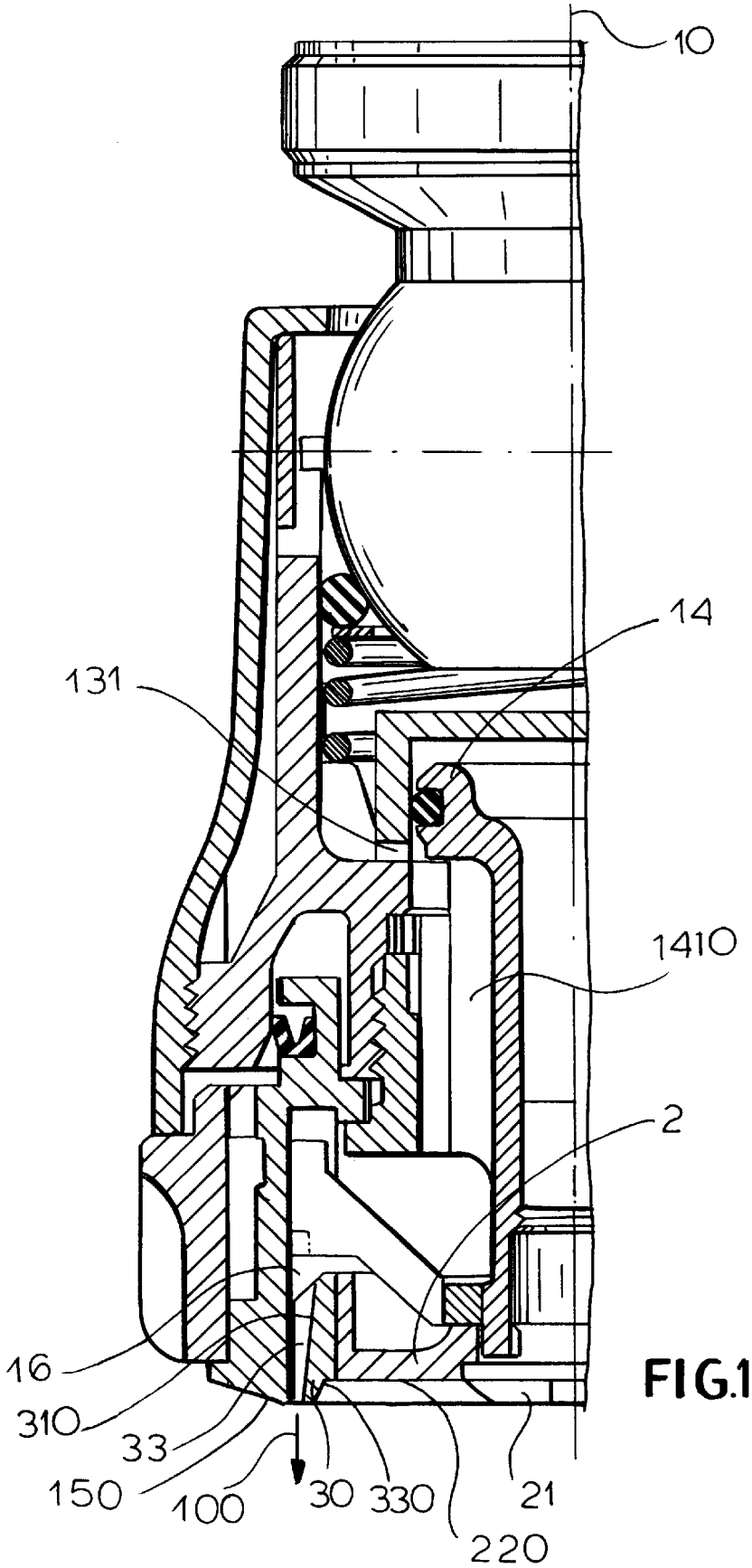
FIGS. 1A and 1B are axial sections through the shower head according to the invention in two different positions.
Figure 1B:
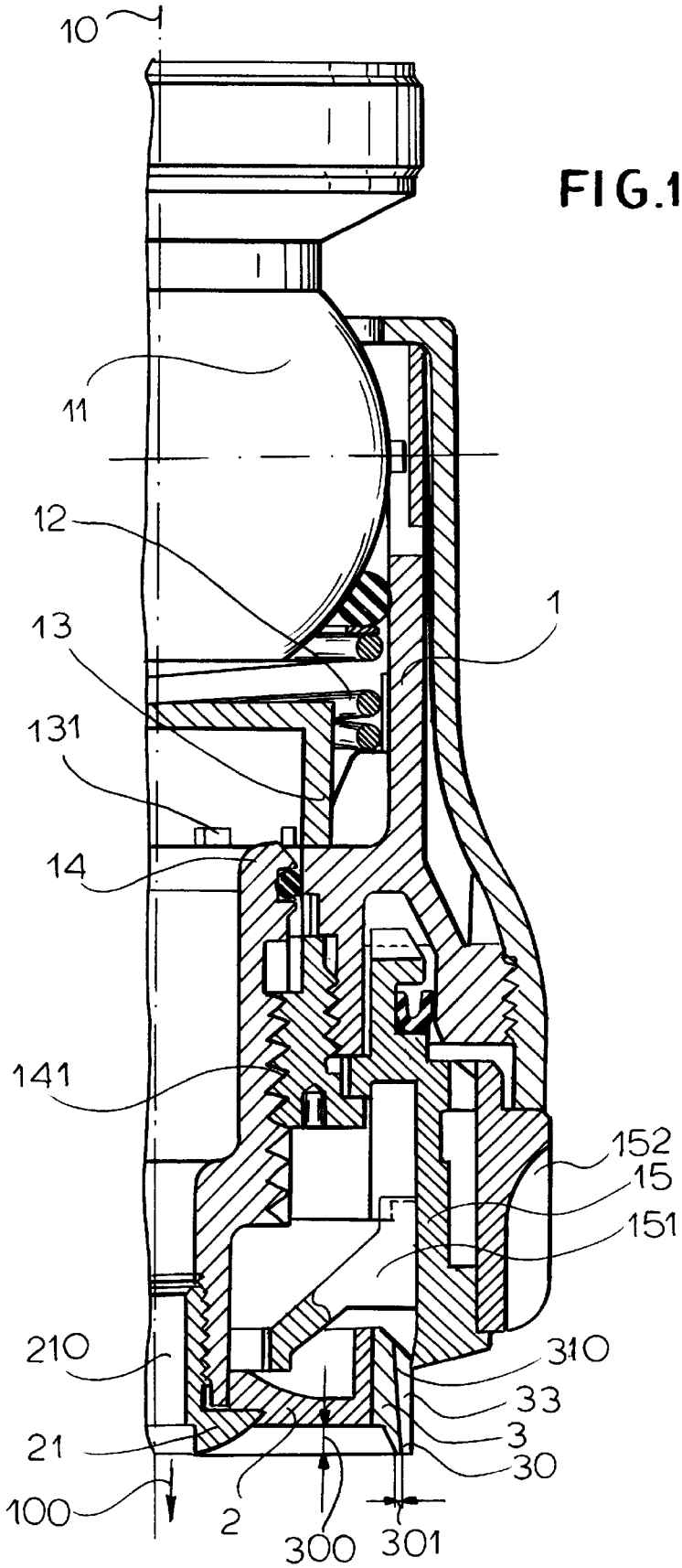

As seen in FIGS. 1A and 1B a shower head according to this invention has a plastic housing 1 centered on an axis 10 and mounted on a ball-type fitting 11 that supplies it with water under pressure. The housing 1 forms a cavity 12 into which the supply fitting 11 opens and is provided internally with a cylindrical cup 13 centered on the axis 10 and formed with radially throughgoing holes 131 allowing the water from the fitting 11 to pass through it.

An end disk 2 is fixed by means of a tubular nut 21 on a sleeve piston or tube 14 secured in the housing 1 by means of a screwthread 141 so that, when rotated in one direction about the axis 10 relative to the housing it moves axially in one direction and when oppositely rotated it moves axially oppositely. An adjustment ring 15 is rotatable on the housing 1 about the axis 10, is coupled via ribs 151 to the piston 14, and has an annular front or downstream end 150. It is fixed to an outer grip ring 152 that allows this ring 15 and the piston 14 to be rotated about the axis 10. Axially extending slots 1410 cut into the outer wall of the piston 14 at the screwthread 141 allow water that has passed through the cup 13 to enter a front chamber 16 of the shower head when the piston 14 is in the rear position shown in FIG. 1A. When the piston 14 is screwed forward into the position of FIG. 1B, water from the chamber 12 is diverted into the interior of the piston 14 and flows out via a central hole 210 in the nut 21 as shown by arrow 100.

According to the invention vulcanized or otherwise bonded to the hard plastic disk 2 is an elastomeric outer ring 3 that is relatively soft, made of a thermoplastic elastomer "Santoprene™" with a Shore A hardness of 35 to 50. This ring 3 is formed as shown in FIGS. 2 through 8 with radially outwardly open, square section, and axially throughgoing grooves 31, 32, 33, and 34 that repeat equiangularly all around the outer periphery of the ring 3. The ring 3 further forms a circular frustotriangular lip 30 projecting downstream past a planar downstream face 220 of the disk 2 and having an axial forward projection 300 of 2 mm and a radial dimension 301 of 0.5 mm at its downstream edge. This lip 30 has an inner wall 303 that is set back at steps behind each set of grooves 31–34 so that the angle this inner wall 303 forms with the axis 10 varies.

Figure 2:
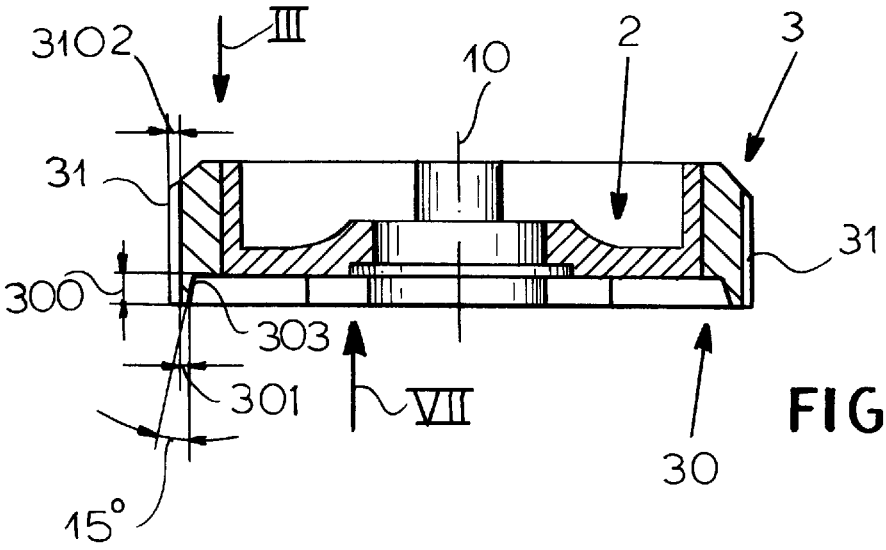
FIG. 2 is an axial section through the end disk of the shower head of FIGS. 1A and 1B.
Figure 3:
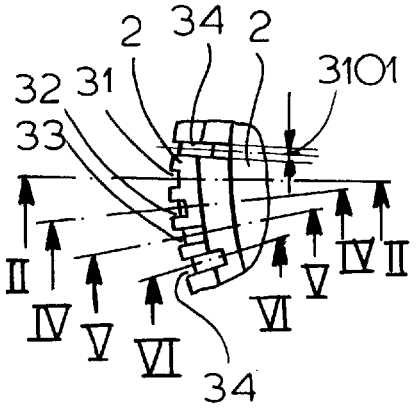
FIG. 3 is an end view taken in the direction of arrow III of a detail of FIG. 2, line II—II showing the section plane of FIG. 2.
Figure 7:
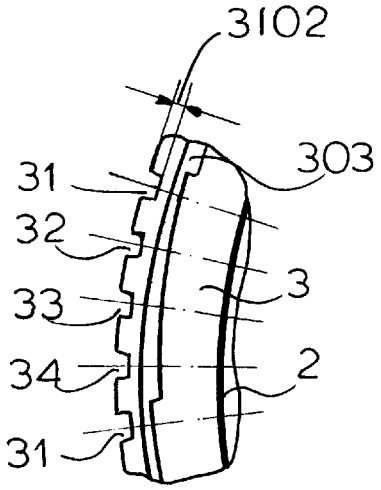
FIG. 7 is an end view of taken in the direction of arrow VII of a detail of FIG. 2.
Figure 4:
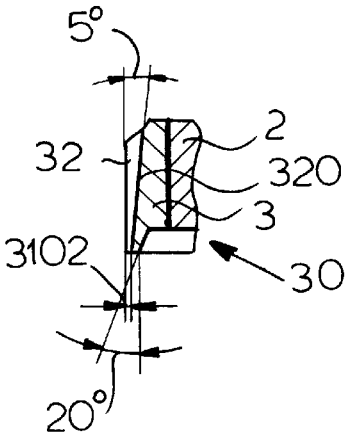
FIGS. 4, 5, and 6 are sections taken along respective lines IV—IV, V—V, and VI—VI of FIG. 3.
Figure 10:
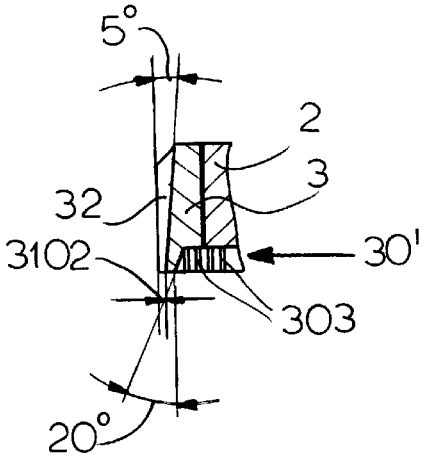
FIGS. 10, 11, and 12 are sections taken along respective lines X—X, XI—XI, and XII—XII of FIG. 9.
Figure 5:
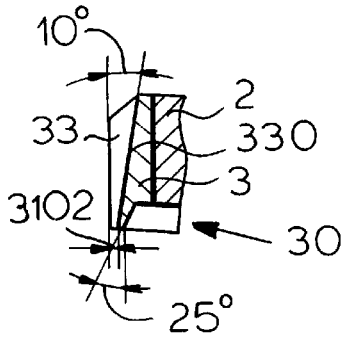
Figure 11:
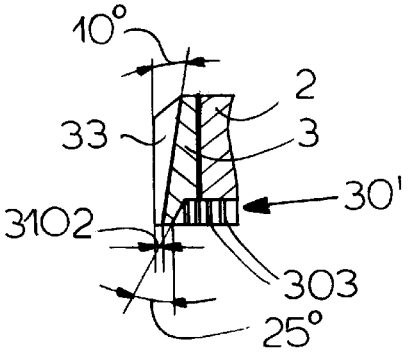
Figure 6:
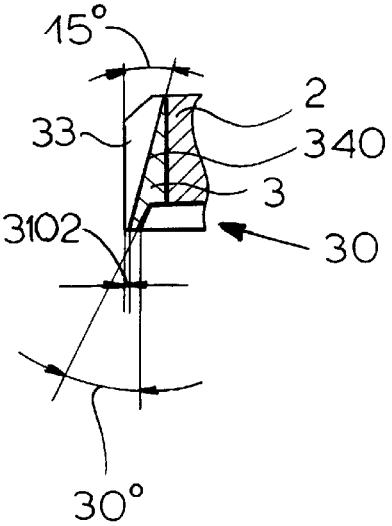
Figure 12:
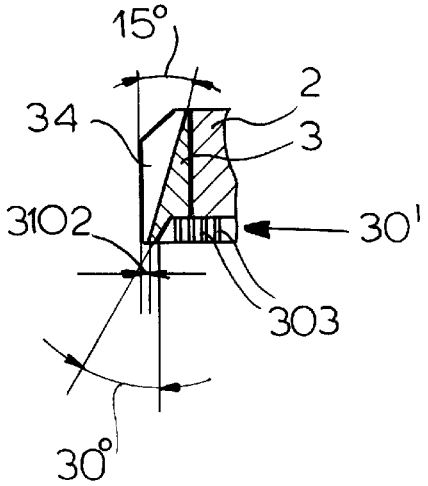
Figure 8:
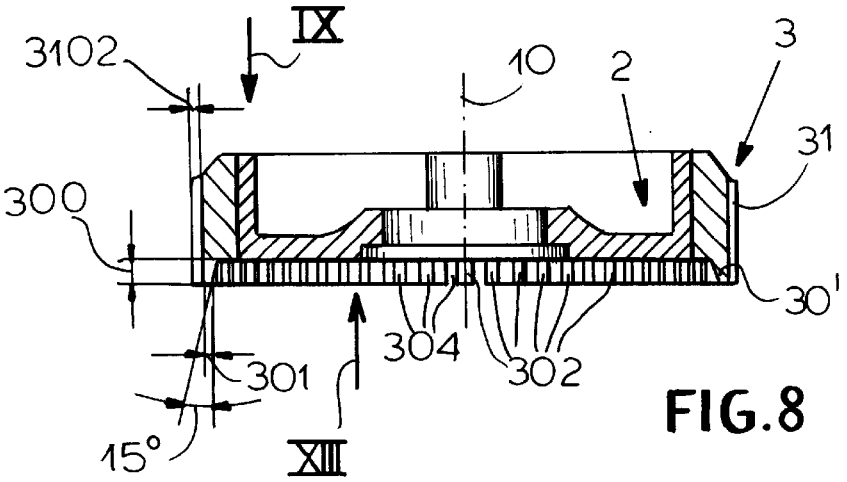
FIG. 8 is a view like FIG. 2 of another end disk according to the invention.
Figure 9:
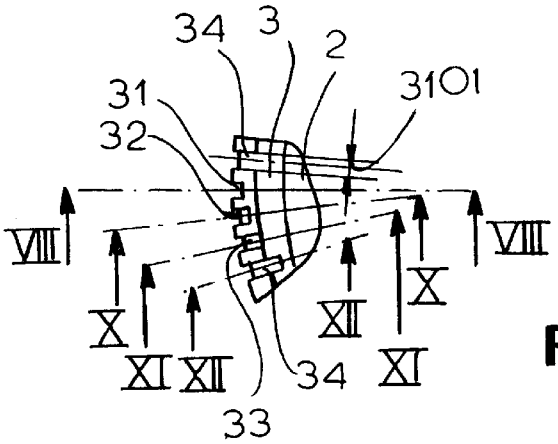
FIG. 9 is an end view taken in the direction of arrow IX of a detail of FIG. 8, line VIII—VIII showing the section plane of FIG. 8.
Figure 13:
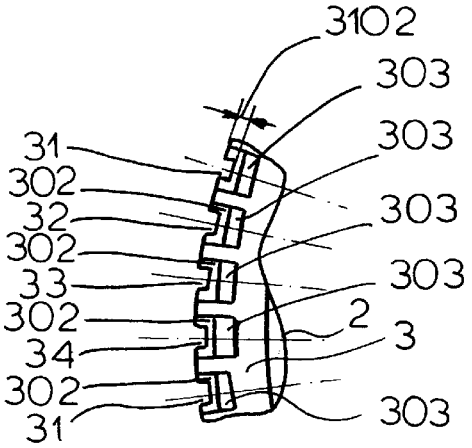
FIG. 13 is an end view taken in the direction of arrow XIII of FIG. 8.

As shown in FIG. 2 the first groove 31 of each groove set has a floor 310 extending parallel to the axis 10 and with a constant depth 3102 of 0.45 mm. The inner wall 303 forms an angle of 15° with the axis behind this groove 31. The second groove 32 (FIG. 4) has a floor 320 extending at an angle of 5° to the axis 10 and has the depth 3102 of 0.45 mm at its downstream end. The inner wall 303 forms an angle of 20° with the axis 10 behind this groove 32. The third groove 33 (FIG. 5) has a floor 330 extending at an angle of 10° to the axis 10 and has the depth 3102 of 0.45 mm at its downstream end. The inner wall 303 forms an angle of 25° with the axis 10 behind this groove 33. The fourth groove 33 (FIG. 6) has a floor 340 extending at an angle of 15° to the axis 10 and has the depth 3102 of 0.45 mm at its downstream end. All the grooves 31, 32, 33, and 34 have an angular width 3101 of 0.9 mm. The inner wall 303 forms an angle of 30° with the axis 10 behind this groove 34. Such groove formations produce a well-filled annular spray pattern.

The system of FIGS. 8 through 13 is substantially identical to that of FIGS. 1 through 7 except that the lip 30' is formed by a multiplicity of small U-section projections 302 in each of which is formed a respective one of the grooves 31–34, so as to create a row of gaps or notches 304. The inner faces 303 of the projections 302 are inclined as in FIGS. 2–6.

The angled groove floors 310–340 ensure that as the disk 2 is moved axially in the housing 1, effective flow cross sections of the grooves 32, 33, and 34 will vary. As the disk 2 moves axially forward or out (down in the drawing) the effective orifice sizes of the grooves 32, 33, and 34 will increase, and when moved back they will decrease. Thus not only does screwing the ring 15 on the housing 1 allow the user to switch between flow from the central hole 210 of from the peripheral grooves 31–34, but this action also allows the flow from the grooves 31–34 to be varied.

When the supply water is shut off such a shower head drains naturally, but always leaves some water typically at the downstream ends of the grooves 31–34, at the extreme front or outer end of the lip 30. Since this water will be exposed to air, it will evaporate and leave behind lime formations. Inside the shower head the humidity is too high for this to take place.

According to the invention the user need merely run his or her hand over the lip 30 to deform it and thereby flake off any lime deposits. The projecting lip 30 is soft and elastically deformable, but structurally stable enough to return to its original position to produce the desired spray pattern.

Although in the illustrated embodiment, the ring 3 is vulcanized to the disk 2, it could have an annular ridge that fits in a complementary groove of the disk 2 to secure the two parts together. Alternately the two parts 2 and 3 could be unitary with each other, cast of the same resin around, for example, a steel plate for rigidity of the central region. In addition it would be possible to mount the disk 2 fixedly on the housing 1, and to move the ring 15 relative to the housing 1. Several such rings 3 could also be provided to provide a dense complex spray. Another such lime-shedding lip 30 could be made around the hole 210.

We claim:

1. A shower head comprising:

a body forming a rear compartment pressurizable with water and a forwardly open mouth having an inner periphery; and an end disk generally closing the mouth, extending perpendicular to an axis, and having an elastically deformable outer rim formed with a plurality of axially throughgoing and radially outwardly open grooves opening rearwardly into the compartment and radially outwardly closed by the body, the rim further forming an annular and elastically deformable lip projecting axially past a downstream face of the disk and a downstream end of the body, the grooves also being formed in the lip.

2. The shower head defined in claim 1 wherein the lip projects axially downstream past the disk face by between 0.1 mm and 5 mm.

3. The shower head defined in claim 1 wherein the rim is unitary with the end disk.

4. The shower head defined in claim 3 wherein the disk is rigid except at the rim.

5. The shower head defined in claim 1 wherein the rim is a separate ring fixed to the disk.

6. The shower head defined in claim 5 wherein the ring is bonded to the disk.

7. The shower head defined in claim 5 wherein the ring is of a rigid plastic and the ring is formed of a thermoplastic elastomer.

8. The shower head defined in claim 1 wherein the lip tapers axially downstream and has an inner wall forming an angle of 20° to 70° with the axis and with a downstream end having a radial thickness of 0.3 mm to 2 mm.

9. The shower head defined in claim 1 wherein the lip is formed by an annular array of projections each formed with a respective one of the grooves.

10. The shower head defined in claim 1 wherein each groove is of generally rectangular section and has a floor directed radially outward away from the axis.

11. The shower head defined in claim 10 wherein at least some of the floors of the grooves are inclined at an acute angle to the axis.

12. The shower head defined in claim 11 wherein the grooves are arrayed in sets and in each set the angle of the respective floors to the axis changes from groove to groove.

13. The shower head defined in claim 11 wherein the inclined groove floors constrict the grooves in a downstream direction.

14. The shower head defined in claim 11 wherein the lip has a stepped inner wall that forms a varying angle with the axis.

15. The shower head defined in claim 14 wherein the angle of the stepped inner wall with the axis varies between 15° and 30°.

16. The shower head defined in claim 11 wherein the grooves have an angular width of about 0.9 mm and a radial width of at least 0.45 mm.

17. The shower head defined in claim 11 wherein the angle the floors are inclined to the axis varies between 0° and 15°.

18. The shower head defined in claim 1 wherein the rim has a Shore A hardness between 35 and 50.

19. The shower head defined in claim 1, further comprising means for axially shifting the disk in the body.

* * * * *